US009751713B2

(12) United States Patent
Balili et al.

(10) Patent No.: US 9,751,713 B2
(45) Date of Patent: Sep. 5, 2017

(54) MULTIPLE EDGE MEDIA STAPLING SYSTEM

(71) Applicant: Lexmark International, Inc., Lexington, KY (US)

(72) Inventors: Dale Bryan Cuesta Balili, Cebu (PH); Roel Firmeza Pantonial, Cebu (PH); Patrick Lawrence Ransom, Lexington, KY (US); Marvin Aliviado Rodriguez, Cebu (PH); Donald Norman Spitz, Lexington, KY (US); William Frank Brown, Jr., Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 453 days.

(21) Appl. No.: 14/574,715

(22) Filed: Dec. 18, 2014

(65) Prior Publication Data

US 2016/0176671 A1 Jun. 23, 2016

(51) Int. Cl.
*B65H 37/04* (2006.01)
*B42B 5/00* (2006.01)
(Continued)

(52) U.S. Cl.
CPC ..... *B65H 37/04* (2013.01); *B42B 5/00* (2013.01); *B65H 29/58* (2013.01);
(Continued)

(58) Field of Classification Search
CPC ..... B65H 29/58; B65H 29/60; B65H 5/26; B65H 31/10; B65H 39/00; B65H 37/04;
(Continued)

(56) References Cited

U.S. PATENT DOCUMENTS 4,421,264 A * 12/1983 Arter ..... B27F 7/17 227/2
4,511,242 A * 4/1985 Ashbee ..... B65H 9/002 198/394

(Continued)

OTHER PUBLICATIONS

Max Co. Ltd., Model EH=C590HP Stapler Head Product Specification, Specification No. 590HP-00-02, issued Apr. 8, 2011.

*Primary Examiner* — Scott A. Smith
(74) *Attorney, Agent, or Firm* — John Victor Pezdek

(57) ABSTRACT

A media stapling system for an image forming device. The media stapling system comprises a stapler mounted on a motor-driven carriage assembly moveably coupled to a track having portions extending along at least two contiguous edges and included corner of a media stack to be stapled. The carriage assembly and track enables stapling in multiple positions along the long and/or short edges and corners of media of varying sizes positioned in a media support. The track is mounted on a planar frame positioned at an angle from horizontal, providing a relatively small footprint. A controller is in operable communication with the media stapling system and an user interface. The user interface provides a plurality of predetermined stapling patterns for selection with the controller controlling the media stapling system to staple the media stack using a selected one of the plurality of stapling patterns.

21 Claims, 12 Drawing Sheets

(51) Int. Cl.
*B65H 29/58* (2006.01)
*G03G 15/00* (2006.01)
*B65H 31/10* (2006.01)

(52) U.S. Cl.
CPC ..... *G03G 15/6538* (2013.01); *B65H 31/10* (2013.01); *B65H 2220/01* (2013.01); *B65H 2402/32* (2013.01); *B65H 2408/1222* (2013.01); *B65H 2801/27* (2013.01); *G03G 2215/00827* (2013.01)

(58) Field of Classification Search
CPC ..... B65H 2402/32; B65H 2801/27; B65H 2408/1222; B65H 2220/01; G03G 15/6538; G03G 2215/00827; B42B 5/00
USPC ..... 227/2, 4, 5, 6, 151, 152, 153, 154, 155, 227/110, 111, 109, 107, 131; 271/279, 271/297, 298, 303, 290, 227; 270/58.09, 270/58.12
See application file for complete search history.

(56) References Cited

U.S. PATENT DOCUMENTS 4,864,350 A * 9/1989 Ishiguro ..... B07C 5/38 270/58.14
5,090,683 A * 2/1992 Kamath ..... B65H 5/34 271/184
5,342,033 A * 8/1994 Iwata ..... B42B 4/00 227/131
5,460,314 A * 10/1995 Udagawa ..... B27F 7/36 227/131
5,573,233 A * 11/1996 Hirai ..... B42C 1/12 270/58.01
5,642,876 A * 7/1997 Ferrara ..... B42C 1/12 270/58.01
5,887,996 A * 3/1999 Castelli ..... B41J 11/0055 271/227
6,059,284 A * 5/2000 Wolf ..... B65H 5/062 271/227
6,062,454 A * 5/2000 Morishige ..... B25C 5/1689 227/1
6,565,076 B2 * 5/2003 Kubota ..... B42C 1/12 227/2
6,948,224 B2 * 9/2005 Coombs ..... G03G 15/6544 227/5
7,165,708 B2 * 1/2007 Motono ..... B27F 7/36 227/120
7,354,037 B2 * 4/2008 Olson ..... B27F 7/19 227/111
9,022,387 B2 * 5/2015 Lee ..... B65H 29/14 271/279
9,061,433 B2 * 6/2015 Nakamura ..... B26D 5/02
9,580,266 B1 * 2/2017 Bell'Albero ..... B65H 29/60
2016/0176671 A1 * 6/2016 Balili ..... B65H 37/04 227/2

* cited by examiner

MULTIPLE EDGE MEDIA STAPLING SYSTEM

CROSS REFERENCE TO RELATED APPLICATIONS

None.

BACKGROUND

1. Technical Field

The present disclosure relates generally to image forming devices and more particularly to finishers and media stapling systems.

2. Description of the Related Art

Finishers, including media stapling systems, for image forming devices generally have capabilities dictated and limited by the size and type of media the image forming device is capable of processing. For example, A3 printers are built with a paper path size that can transport media widths up to at least a length of a long edge of A4 media (297 mm). An A3 finisher takes advantage of its wider paper path to feed media up to A4 size (210 mm×297 mm) in either short-edge-first or long-edge-first orientation. Then, by providing a simple, straight-line transport method for its stapler cartridge system at 90 degrees to its paper path, the A3 device can position staples along either the short-edge or long-edge of media, up to the maximum width of their paper transport system. Thus, for A3 finishers, stapling multiple media sizes up to A4 in portrait, landscape and along both short-edge and long-edge dual positions is relatively easy. However, it is up to the user to load media in the correct orientation in the printer input tray to achieve the desired finishing job. For example, letter sized media cannot be stapled in a dual pattern along its short edge unless it is loaded to feed short-edge-first in the input tray. This same limitation is true for all of the media handled by A3 finishers. The user must orient the media correctly in the input tray to obtain the desired stapling output.

For image forming devices handling smaller media, the options for stapling media are limited even more. A4 printers are limited in their media transport systems to media widths up to only the width of letter media (216 mm×279 mm). This makes it difficult to load media long-edge-first. This, in turn, makes it difficult to have a stapling system employing a straight-line transport method to be capable of stapling along both the short edge and the long edge of media. Further with both stapling systems, staples are not placed diagonally in the corners of the media but rather the staples are placed parallel to the long and or short edges.

There is therefore a need in the art for a media stapling system capable of stapling along both the short edge and the long edge of media, without the user needing to orient the media to be stapled. It would also be advantageous to have a media stapling system capable of providing stapling positions diagonally across the corners of the media.

SUMMARY

Disclosed is a media stapling system for an image forming device. The media stapling system comprises: a media support for holding a media stack having at least two media sheets for stapling; a track assembly having a support and a track mounted thereon, the support and media support having parallel planar orientations, the track having at least two contiguous track portions each having a rack thereon forming a continuous length therealong, the track positioned proximate to the media support with the at least two contiguous track portions being parallel to at least two contiguous edges of the media stack; a carriage moveably coupled to the rack on the track; a position sensor disposed on the carriage for sensing the position of the carriage on the track; a stapler mounted on the carriage; a drive mechanism coupled to the rack and the carriage for moving the carriage and stapler along the track; and a controller in operable communication with to the drive mechanism, the position sensor and the stapler. The controller is configured to energize the drive mechanism to move the carriage and stapler along the track to at least one predetermined stapling position along the at least two contiguous edges of the media stack and, when at the one or more predetermined positions, energizing the stapler to staple the media stack.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
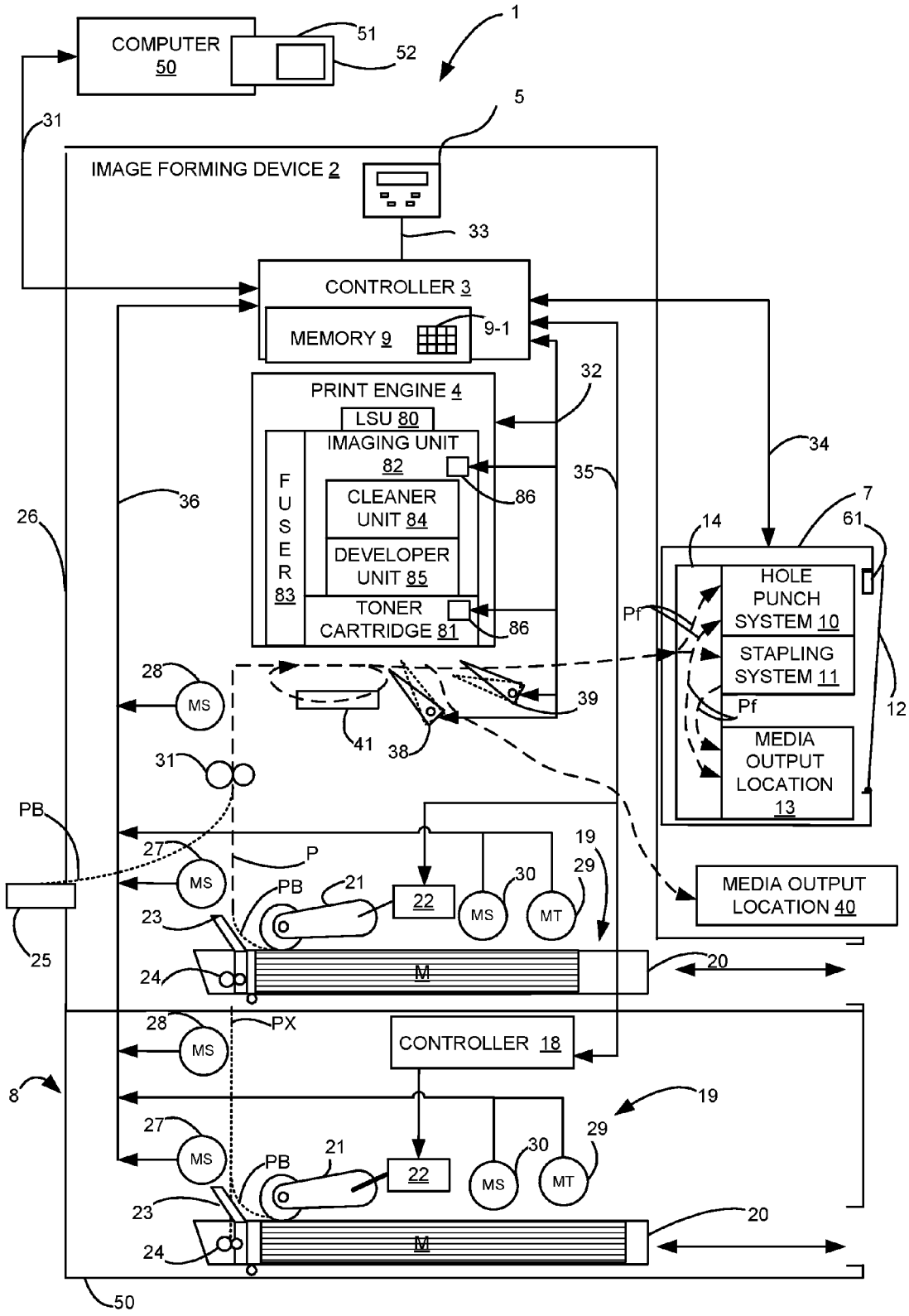
FIG. 1 is a schematic view of an imaging system according to one example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including," "comprising," or "having" and variations thereof herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear" and "side" "under", "below", "lower", "over", "upper", "up", "down" and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the present disclosure and that other alternative mechanical configurations are possible.

It will be further understood that each block of the diagrams, and combinations of blocks in the diagrams, respectively, may be implemented by computer program instructions. These computer program instructions may be loaded onto a general purpose computer, special purpose computer, or other programmable data processing apparatus to produce a machine, such that the instructions which execute on the computer or other programmable data processing apparatus may create means for implementing the functionality of each block or combinations of blocks in the diagrams discussed in detail in the descriptions below. These computer program instructions may also be stored in a non-transitory, tangible, computer readable storage medium that may direct a computer or other programmable data processing apparatus to function in a particular manner, such that the instructions stored in the computer readable storage medium may produce an article of manufacture including an instruction means that implements the function specified in the block or blocks. Computer readable storage medium includes, for example, disks, CD-ROMS, Flash ROMS, nonvolatile ROM and RAM. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions specified in the block or blocks. Output of the computer program instructions, such as the process models and the combined process models, as will be described in greater detail below, may be displayed in a user interface or computer display of the computer or other programmable apparatus that implements the functions or the computer program instructions.

As used herein, the term "communication link" is used to generally refer to structure that facilitates electronic communication between multiple components, and may operate using wired or wireless technology. While several communication links are shown, it is understood that a single communication link may serve the same functions as the multiple communications link that are illustrated.

As used herein, the term "media width" refers to the dimension of the media that is transverse to the direction of the media path. The term "media length" refers to the dimension of the media that is aligned to the direction of the media path. The media is said to move along the media path and the media path extensions from an upstream location to a downstream location as it moves from the media trays to the output area of the image forming apparatus. For each option tray, the top of the option tray is downstream from the bottom of the option tray. Conversely, the bottom of the option tray is upstream from the top of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. "Media process direction" describes the movement of media within the imaging system as is generally meant to be from an input toward an output of the imaging system. Further relative positional terms are used herein. For example, "superior" means that an element is above another element. Conversely "inferior" means that an element is below or beneath another element. Positional terms such as "upper," " lower," "top," "bottom;" "right," "left" are used with relation to how devices or elements are depicted in the figures.

With respect to media, the term "output" as used herein encompasses media produced from any printing device such as color and black-and-white copiers, color and black-and-white printers, and multifunction devices that incorporate multiple functions such as scanning, copying, and printing capabilities in one device. Such printing devices may utilize ink jet, dot matrix, dye sublimation, laser, and any other suitable print formats. Output may also be used to refer to media processed by a finisher.

The term "button" as used herein means any component, whether a physical component or graphic user interface icon, that is engaged to initiate an action or event.

Referring now to the drawings and particularly to FIG. 1, there is shown a diagrammatic depiction of an imaging system 1. As shown, imaging system 1 may include an image forming device 2, and an optional computer 50 attached to the image forming device 2. Imaging system 1 may be, for example, a customer imaging system. Image forming device 2 is shown as a printer that includes a controller 3, a print engine 4, a user interface 5, a finisher 7 and/or one or more option assemblies 8.

Controller 3 includes a processor unit and associated memory 9, and may be formed as one or more Application Specific Integrated Circuits (ASICs). Memory 9 may be any volatile or non-volatile memory of combination thereof such as, for example, random access memory (RAM), read only memory (ROM), flash memory and/or non-volatile RAM (NVRAM). Alternatively, memory 9 may be in the form of a separate electronic memory (e.g., RAM, ROM, and/or NVRAM), a hard drive, a CD or DVD drive, or any memory device convenient for use with controller 3. Finisher 7 a hole punch system 10 having associated motors and sensors and a stapling system 11 also having associated motors and sensors. Image forming device 2 may also be configured to include a document scanner.

In FIG. 1, controller 3 is illustrated as being communicatively coupled with computer 50 via communication link 31 using a standard communication protocol, such as for example, universal serial bus (USB), Ethernet or IEEE 802.xx. Controller 3 is illustrated as being communicatively coupled with print engine 4, user interface 5, and finisher 7, including stapling system 10, via communication links 32, 33, 34, respectively. As used herein, the term "communication link" generally refers to a structure that facilitates electronic communication between two components, and may operate using wired or wireless technology. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. Computer 50 includes in its memory 51 a software program including program instructions that function as an imaging driver 52, e.g., printer/scanner driver software, for image forming device 2. Imaging driver 52 is in communication with controller 3 of image forming device 2 via communication link 31. Imaging driver 52 facilitates communication between image forming device 2 and computer 50. One aspect of imaging driver 52 may be, for example, to provide formatted print data to image forming device 2, and, more particularly, to print engine 4, to print an image.

In some circumstances, it may be desirable to operate image forming device 2 in a standalone mode. In the standalone mode, image forming device 2 is capable of functioning without computer 50. Accordingly, all or a portion of imaging driver 52, or a similar driver, may be located in controller 3 of image forming device 2 so as to accommodate printing and/or scanning functionality when operating in the standalone mode.

Print engine 4, user interface 5 and finisher 7 may include firmware maintained in memory 9 which may be performed by controller 3 or another processing element. Controller 3 may be, for example, a combined printer, scanner and finisher controller. Controller 3 serves to process print data and to operate print engine 4 during printing. Controller 3 may provide to computer 50 and/or to user interface 5 status indications and messages regarding the media, including scanned media and media to be printed, image forming device 2 itself or any of its subsystems, consumables status, etc. Computer 50 may provide operating commands to image forming device 2. Computer 50 may be located nearby image forming device 2 or remotely connected to image forming device 2 via an internal or external computer network. Image forming device 2 may also be communicatively coupled to other image forming devices.

Print engine 4 is illustrated as including laser scan unit (LSU) 80, a toner cartridge 81, an imaging unit 82, and a fuser 83, all mounted within image forming device 2. Imaging unit 82 and toner cartridge 81 are supported in their operating positions so that toner cartridge 81 is operatively mated to imaging unit 82 while minimizing any unbalanced loading forces by the toner cartridge 81 on imaging unit 82. Imaging unit 82 is removably mounted within image forming device 2 and includes a developer unit 85 that houses a toner sump and a toner delivery system. The toner delivery system includes a toner adder roll that provides toner from the toner sump to a developer roll. A doctor blade provides a metered uniform layer of toner on the surface of the developer roll. Imaging unit 82 also includes a cleaner unit 84 that houses a photoconductive drum and a waste toner removal system. Toner cartridge 81 is also removably mounted in image forming device 2 in a mating relationship with developer unit 85 of imaging unit 82. An exit port on toner cartridge 81 communicates with an entrance port on developer unit 85 allowing toner to be periodically transferred from toner cartridge 81 to resupply the toner sump in developer unit 85. Both imaging unit 82 and toner cartridge 81 are replaceable items for image forming device 2. Imaging unit 82 and toner cartridge 81 may each have a memory device 86 mounted thereon for providing component authentication and information such as type of unit, capacity, toner type, toner loading, pages printed, etc.

The electrophotographic imaging process is well known in the art and, therefore, will be briefly described. During an imaging operation, laser scan unit 80 creates a latent image on the photoconductive drum in cleaner unit 84. Toner is transferred from the toner sump in developer unit 85 to the latent image on the photoconductive drum by the developer roll to create a toned image. The toned image is then transferred to a media sheet received in imaging unit 82 from one of media input trays 20 or multipurpose tray 25. Next, the toned image is fused to the media sheet in fuser 83 and the media sheet is directed by diverter gates 38, 39 to one of media output location 40, finisher 7 or a duplexer 41. Toner remnants are removed from the photoconductive drum by the waste toner removal system housed within cleaner unit 84. As toner is depleted from developer unit 85, toner is transferred from toner cartridge 81 into developer unit 85. Controller 3 provides for the coordination of these activities occurring during the imaging process.

While print engine 4 is illustrated as being an electrophotographic printer, those skilled in the art will recognize that print engine 4 may be, for example, an ink jet printer and one or more ink cartridges or ink tanks or a thermal transfer printer; other printer mechanisms and associated image forming material.

Controller 3 also communicates with a controller 18 in option assembly 8, via communication links 35, provided within each option assembly 8 that is included in imaging forming device 2. Controller 18 operates various motors housed within option assembly 8 that position media for feeding, feed media from media path branches PB into media path P or media path extensions PX as well as feed media along media path extensions PX. Controllers 3, 18 control the feeding of media along media path P and control the travel of media along media path P and media path extensions PX.

Image forming device 2 and option assembly 8 each also include a media feed system 19 having a removable media input tray 20 for holding media M to be printed or scanned, and a pick mechanism 21, a drive assembly 22 positioned adjacent removable media input trays 20. Each media tray 20 also has a media dam assembly 23 and a feed roll assembly 24. In image forming device 2, pick mechanism 21 is mechanically coupled to drive assembly 22 that is controlled by controller 3 via communication link 35. In option assembly 8, pick mechanism 21 is mechanically coupled to drive assembly 22 that is controlled by controller 3 via controller 18 and communication link 35. In both image forming device 2 and option assembly 8, pick mechanisms 21 are illustrated in a position to drive a topmost media sheet from the media stack M into media dam 23 which directs the picked sheet into media path P or extension PX. As is known, media dam 23 may contain one or more separator rolls and/or separator strips used to prevent shingled feeding of media from media stack M. Feed roll assemblies 24 feed media from an inferior unit to a superior unit via a slot provided therein. An additional feed roll assembly 31 is shown positioned downstream of the media tray 20 in image forming device 2 to direct the picked media to printer engine 4. As is known, feed roll assemblies 24, 31 consist of a driven roll and an opposed idler roll. The respective driven rolls are connected to one or more motors (not shown) that is under control of controller 3 or 18.

In image forming device 2, a media path P (shown in dashed line) is provided from removable media input tray 20 extending through print engine 4 to media output location 40, or, when needed, to finisher 7 or to duplexer 41. Media path P may also have extensions PX and/or branches PB (shown in dotted line) from or to other removable media input trays as described herein such as that shown in option assembly 8. Media path P may include a multipurpose input tray 25 provided on housing 26 of image forming device 2 or incorporated into removable media tray 20 provided in housing 26 and corresponding path branch PB that merges with the media path P within image forming device 2. Along media path P and its extensions PX are provided media position sensors 27, 28 which are used to detect the position of the media, usually the leading and trailing edges of the media, as it moves along the media path P or path extension PX. Media position sensors 27 are located adjacent to the point at which media is picked from each of media trays 20 while media position sensors 28 are positioned further downstream from its respective media tray 20 along media path P or path extension PX. Additional media position sensors may be located throughout media path P and a duplex path, when provided, and their positioning is a matter of design choice. Media position sensors, such as an optical interrupter, detect the leading and trailing edges of each sheet of media as it travels along the media path P or path extension PX.

Media type sensors 29 are provided in image forming device 2 and each option assembly 8 to sense the type of media being fed from removable media input trays 20.

Media size sensors 30 are provided in image forming device 2 and each option assembly 8 to sense the size of media being feed from removable media input trays 20. To determine media sizes such as Letter, A4, A6, Legal, etc., media size sensors 30 detect the location of adjustable trailing edge media supports and one or both adjustable media side edge media supports provided within removable media input trays 20 as is known in the art. Media sensors 27-30 are shown in communication with controller 3 via communication link 36.

In FIG. 1, finisher 7 is shown mounted outside of housing 26. Finisher 7 may include one of a hole punch system 10 and a stapling system 11 or both systems 10, 11 that may be accessed via a door 12. An media output area 13 may be is provided on finisher 7 for storing punched and/or stapled media sheets. A media feed system 14 interconnects hole punch system 10, stapling system 11 and media output area 13 along a media path Pf in finisher 7. Media feed system 14 receives printed media sheets from image forming device 2 and routes it along media path Pf to hole punch system 10, stapling system 11 or both and thereafter to media output area 13. Media feed system 14 is in operable communication with controller 3 via communication link 34. Stapling system 11 staples a media stack having two or more printed media sheets. Stapling system 11 is translatable about the edges of the media stack to be stapled allowing for top edge, left edge, or right edge stapling at one or more locations along such edges and diagonally on the corners of the media stack between the left and right edges and the top edge. Stapling system 11 typically has a capacity to staple together about fifty media sheets of standard 20 pound weight, but this will vary based on the weight (thickness) of the media sheets. Also provided on door 12 of finisher 7 is a door open sensor 61 that may be used to control movement the stapler in stapling system 11 and/or to suspend or stop operation of hole punch system 10.

Finisher 7 is illustrated as being in communication with media path P via diverter gate 39 that is movable between at least two positions (as indicated by the dashed line image). When printed media sheets need to be stapled, controller 3 actuates diverter gate 39, via communication link 32, moving diverter gate 39 to a second positioned as indicated by the dashed line image to direct the media sheets to media feed system 13 in finisher 7 which routes the received media sheets to stapling system 11. Media not needing a finisher function would be directed by diverter gate 39 to media output location 40.

Option assembly 8 includes feed system 19 with removable media input tray 20, pick mechanism 21, drive mechanism 22, media dam assembly 23 and feed roll assembly 24. Image forming apparatus 2 is at the top of the stack and sits on the top of option assembly 8. Latches and alignment features are provided between adjacent units within the stack. An adjacent unit is either an image forming apparatus 2 or another option assembly 8. Additional option assemblies 8 may be added to the stack between image forming apparatus 2 and the attached option assembly 8 or below it. As each option assembly 8 is added, an extension PX to the media path P is also added. The media path extension PX within each option assembly 8 is comprised of two branches which eventually merge at a point above their respective housing 50, either, depending on location within the stack, within a superior option assembly 8 or within image forming device 2 itself.

Media sheets M are introduced from removable media input tray 20 and moved along the media path P and or a path extension PX during the image formation process. Each removable media input tray 20 is sized to contain a stack of media sheets M that will receive color and/or monochrome image. When used for feeding media sheets to a scanner, removable media input tray 20 would contain media sheets having images that would be scanned. Each image forming device 2 may include one or more input options for introducing the media sheets. Each removable media input tray 20 may have the same or similar features. Each removable media input tray 20 may be sized to hold the same number of media sheets or may be sized to hold different quantities of media sheets. In some instances, the removable media input tray 20 found in image forming apparatus 2 may hold a lesser, equal or greater quantity of media than a removable media input tray 20 found in an option assembly 8. As illustrated removable media input tray 20 is sized to hold approximately 550 pages of 20 pound media which has a media stack height of about 59 mm and, at this stack height, would be considered full. For lighter or heavier weight media, the number of pages with this stack height would of course vary depending on the thickness of the media. If additional media were added, removable media input tray 20 would be considered to be overfilled. Typically, removable media input tray 20 in option assembly 8 is insertable into a housing 70 of another option assembly 8, but this is not a requirement or limitation of the design.

Figure 2:
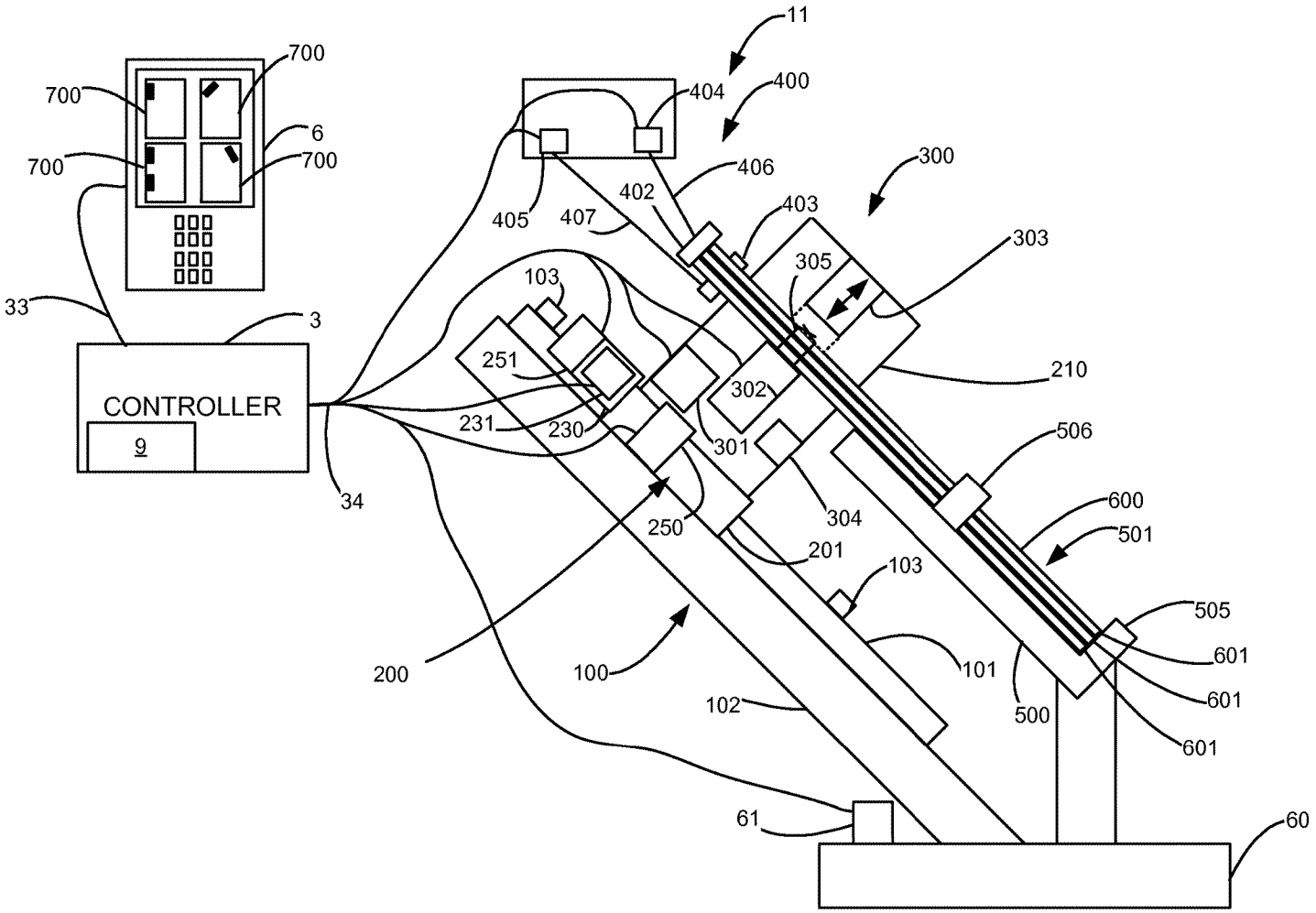
FIG. 2 is an electromechanical schematic of one embodiment of a stapling system of the present disclosure.

Referring to FIG. 2, there is illustrated a schematic representation of stapling system 11. Stapling system 11 includes a track assembly 100, a carriage assembly 200 moveably coupled to a continuous track 101 of track assembly 100, a stapler 300 mounted on carriage assembly 200, a tamping assembly 400 and a media support 500 forming a media receiving area 501 for holding a media stack 600 containing media sheets 601 to be stapled.

Figure 10:
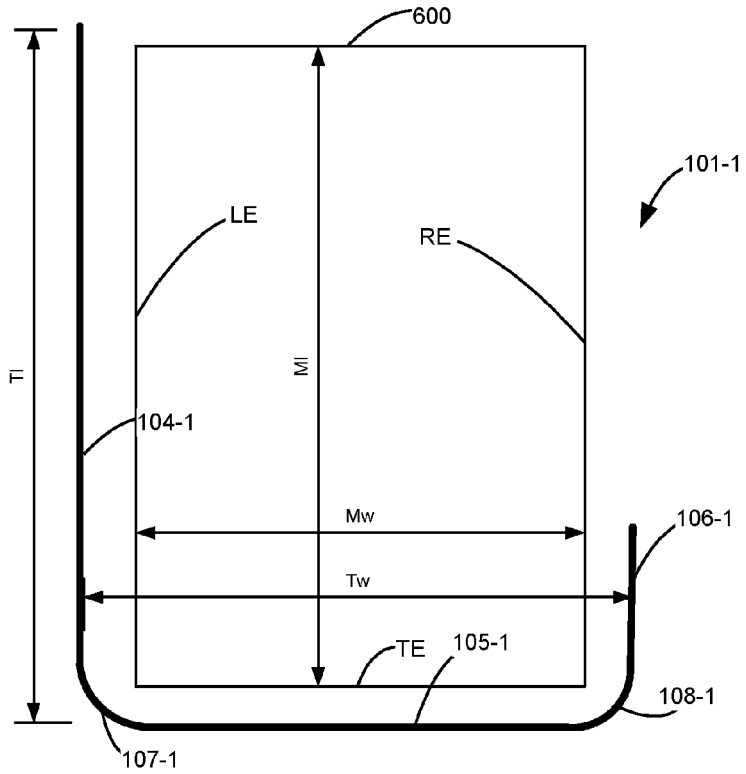
FIG. 10 is a schematic illustration of a J-shaped track assembly.

For the purposes of description and not limitation, media stack 600 has a top edge TE, a bottom edge BE, a right edge RE and a left edge LE and is oriented so that the top and bottom edges TE, BE are the short edges while the right and left edge, RE, LE are the long edges (See FIG. 10). In the figures, media stack 600 is illustrated in an inverted position when resting on media support 500 with the top edge TE being lower than the bottom edge BE and with the first or top media sheet 601 of a given stapling job being on the bottom of the media stack 600 and the last media sheet of a given stapling job being on the top. However, the order of the media sheets 601 in media stack is a matter of design choice and not a limitation. The portions of track 101 and alignment guides found in tamping assembly 400 that are adjacent to these edges of media stack 600 will be similarly designated, e.g. left edge track portion, top edge alignment guide etc.

Track assembly 100, includes a continuous track 101 on mounted on a track support plate 102 that is mountable to a frame 60 in finisher 7. Track assembly 100 is shown installed at an acute angle θ with respect to horizontal (see FIG. 4). Installing stapling system 10 at an acute angle θ reduces the space required for finisher 7. In one example embodiment, acute angle θ is 45°, but may range between about 10° to about 80° depending on the means employed to stabilize media stack 600 in the media receiving area 501. This mounting angle should not be considered as a limitation of the design.

Track 101 may have different configurations as described below, but, in one form, has a first and a second track portions extending parallel to a corresponding a first long edge and an adjoining short edge of media stack 600, e.g. the left and top edges of media stack 600. This allows the carriage assembly 200 to move along the track 101 to position a stapler 300 at desired stapling locations along the long edge and/or short edge, as well as the adjoining corner of the media stack 600. The stapling locations are determined using either a default stapling pattern or one of a number of user-selected stapling patterns, generally designated with reference numeral 700, stored in memory 9 and displayed on user interface 5. Other configurations of track 101 may be used, as long as at least two contiguous portions extend substantially parallel to corresponding contiguous edges of media stack 600 in the media receiving area 501. Track assembly 100 also includes one or more position flags, generally designated by reference numeral 103, at predetermined locations. Position flags 103 are sensed by a flag sensor 250 on carriage assembly 200 to allow controller 3 to determine the position of stapler 300 with respect to track 101 and the corresponding edges of media stack 600. A carriage position encoder 251 is also provided in drive assembly 230 to aid in positioning of stapler 300.

Carriage assembly 200 includes carriage 201 moveable coupled to track 101 and moveable along track 101 along the LE edge of media stack 600, around corners formed between the left edge LE and top edge TE and right edge RE and top edge TE of media stack 600 and, in one configuration, along a portion of the right edge RE of media stack 600 and in another configuration along the length of the right edge RE of media stack 600. Stapler 300 is mounted to carriage 201. Drive assembly 230 is coupled to track 101 and is used to move carriage assembly 200 to the desired stapling locations. Drive assembly 230 includes a reversible motor 231. Carriage flag sensor 250 is positioned on carriage 220 so that carriage flag sensor 250 is actuated by the position flags 103 as the carriage 201 passes by each position flag 103 on track 101. Carriage position encoder 251 is attached to motor 231 and is rotated thereby to provide a signal used to determine carriage position along track 101. A door position sensor 61 may be provided and is illustrated as mounted on frame 60 of finisher 7. Door position sensor 61 provides a signal to controller 3 and, when actuated due to a door of the finisher 7 being opened, that signal may used to return carriage assembly 200 to a predetermined position on track 101. Carriage flag sensor 250 and door position sensor 61 may be an optical interrupter type sensor, a micro switch sensor or other equivalent sensor as is known in the art.

Stapler 300 includes a motor 301, stapler head 302, anvil 303 and staple supply spool 304 for supplying staples to stapler head 302. Motor 301 moves anvil 303 with respect to stapler head 302, as indicated by the dashed lines and doubled headed arrow. During a stapling operation anvil 303 is moved toward stapler head 302 to trap media stack 600 therebetween. Stapler head 302 fires a U-shaped staple 305 through the first or bottom media sheet 601 of the trapped media stack 600 to and through the last or top media sheet. The ends of the staple 305 being driven against anvil 303, cinching against the last media or top media sheet 601 in media stack 600 together.

Tamping assembly 400 is positioned adjacent to media support area 501. Top edge and left edge (front as viewed) alignment guides 505, 506 are provided along the bottom and left sides of media support area 501. Media support 500 and alignment guides 505, 506 hold the media sheets 601 in place, while the tamping assembly 400 is used to align the media sheets 601 into media stack 600 prior to stapling. Bottom edge and right edge (rear as viewed) tamping arms 402, 403 are connected to first and second tamping motors 404, 405 via first and second translating drive mechanisms 406, 407, respectively. Tamping arm 402, when actuated, moves the media sheets 601 against top edge alignment guide 505 while tamping arm 403, when actuated, moves the media sheets 601 against left edge alignment guide 506.

Door sensor 61, carriage motor 231, flag sensor 250, carriage position encoder 251, stapler motor 301, stapler head 302, and first and second tamping motors 404, 405 are in operable communication with controller 3 via communication link 34.

The media receiving area 501 on media support 500 is sized to hold a number of media sheets 601 depending on the capacity of the stapler 300. Typically, stapler 300 has a capacity to staple together about fifty media sheets of standard 20 pound weight, but this will vary based on the media type (thickness) of the media sheets. The signals received from media type sensors 30 by controller 3 may be used to limit the number of media sheets 601 sent to stapling system 11.

Figure 3:
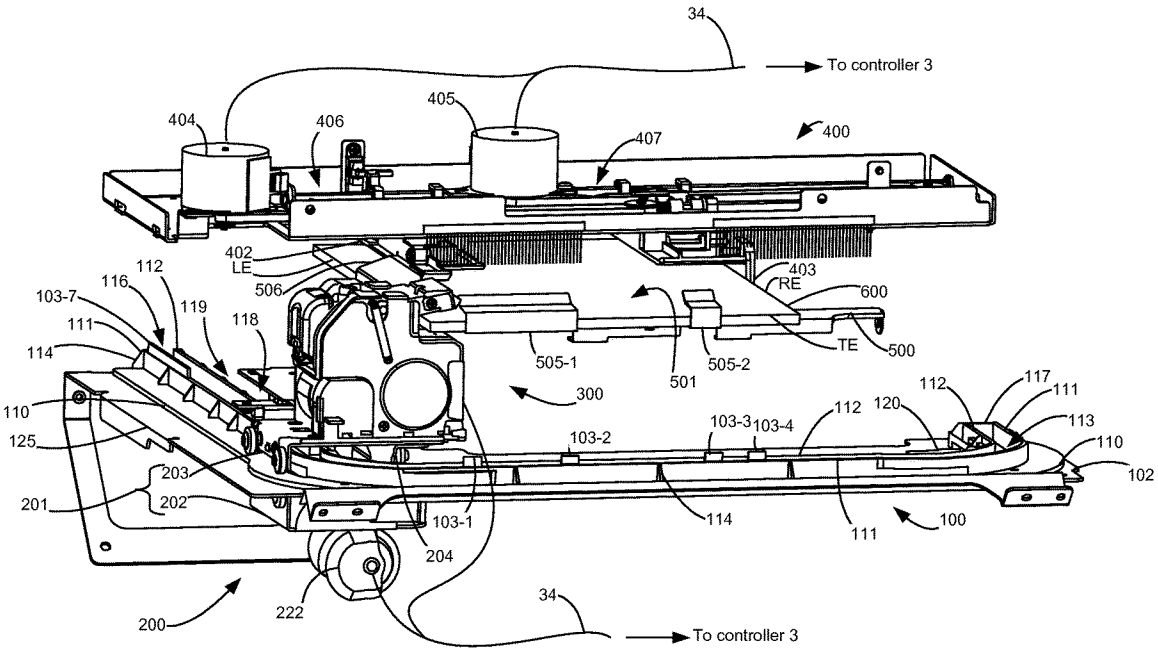
FIG. 3 is perspective view of an example embodiment of the stapling system of FIG. 2.
Figure 4:
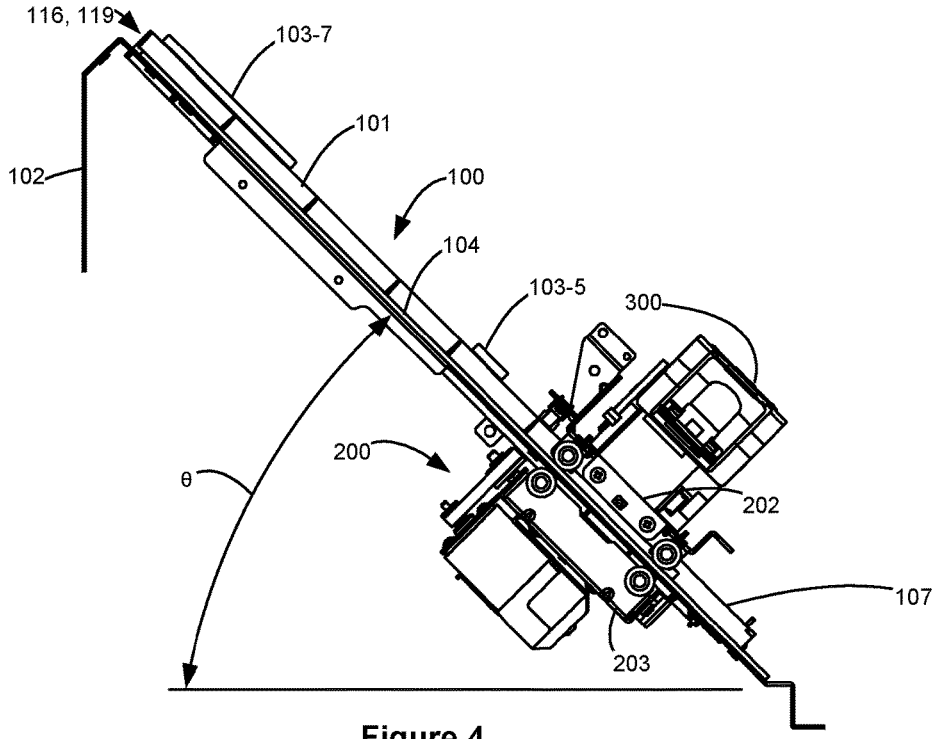
FIG. 4 is a side elevational view of one embodiment of a stapling system.
Figure 5:
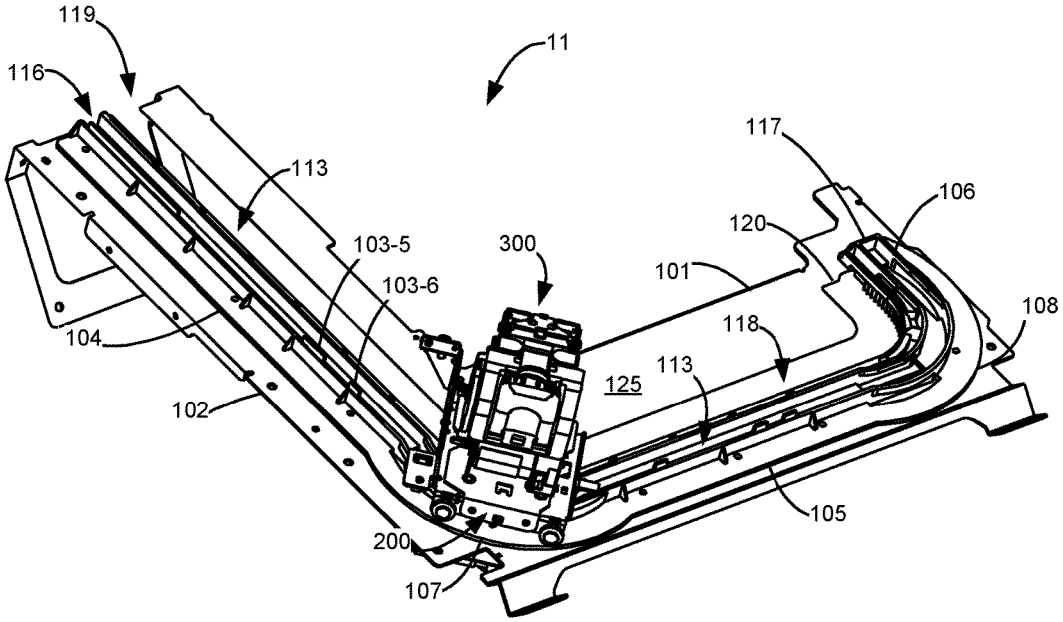
FIG. 5 is a perspective view of the stapling system of FIG. 4 positioned to diagonally place a staple across a corner.

FIGS. 3-5 illustrate an example embodiment of the stapling system 11 illustrated in FIG. 2. For purposes of illustration only, stapling system 11 is shown in a horizontal orientation and frame 60 has been removed. Carriage assembly 200 and stapler 300 are shown in a predetermined ready position which is illustrated as being adjacent to the intersection of the left edge LE and top edge TE of media stack 600. This location is a common area in which staples are placed and by having stapler 300 positioned there saves time in the stapling process.

Figure 6:
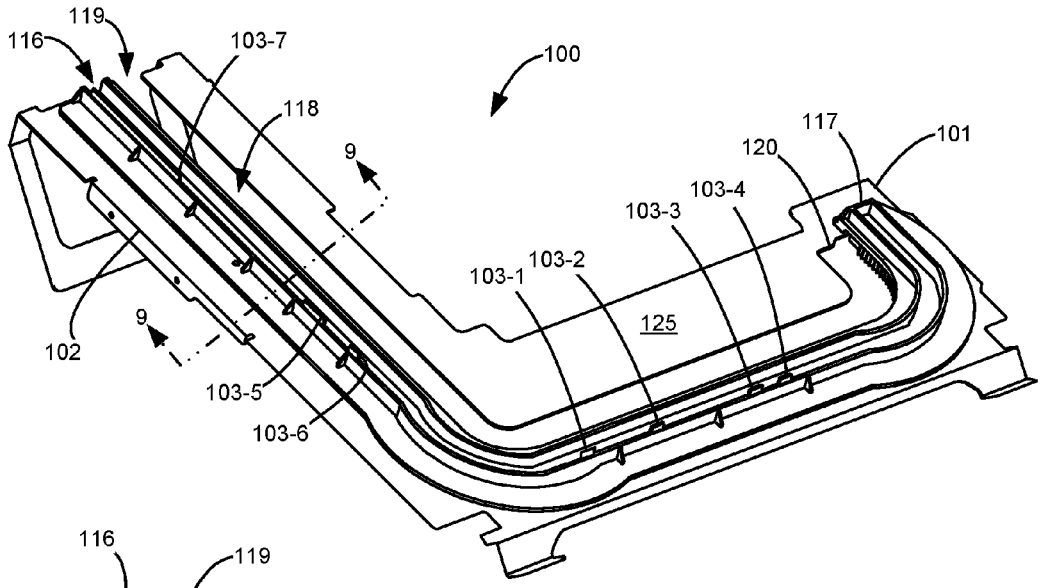
FIG. 6 shows a perspective of the track assembly used with the stapling system shown in FIG. 3.
Figure 7:
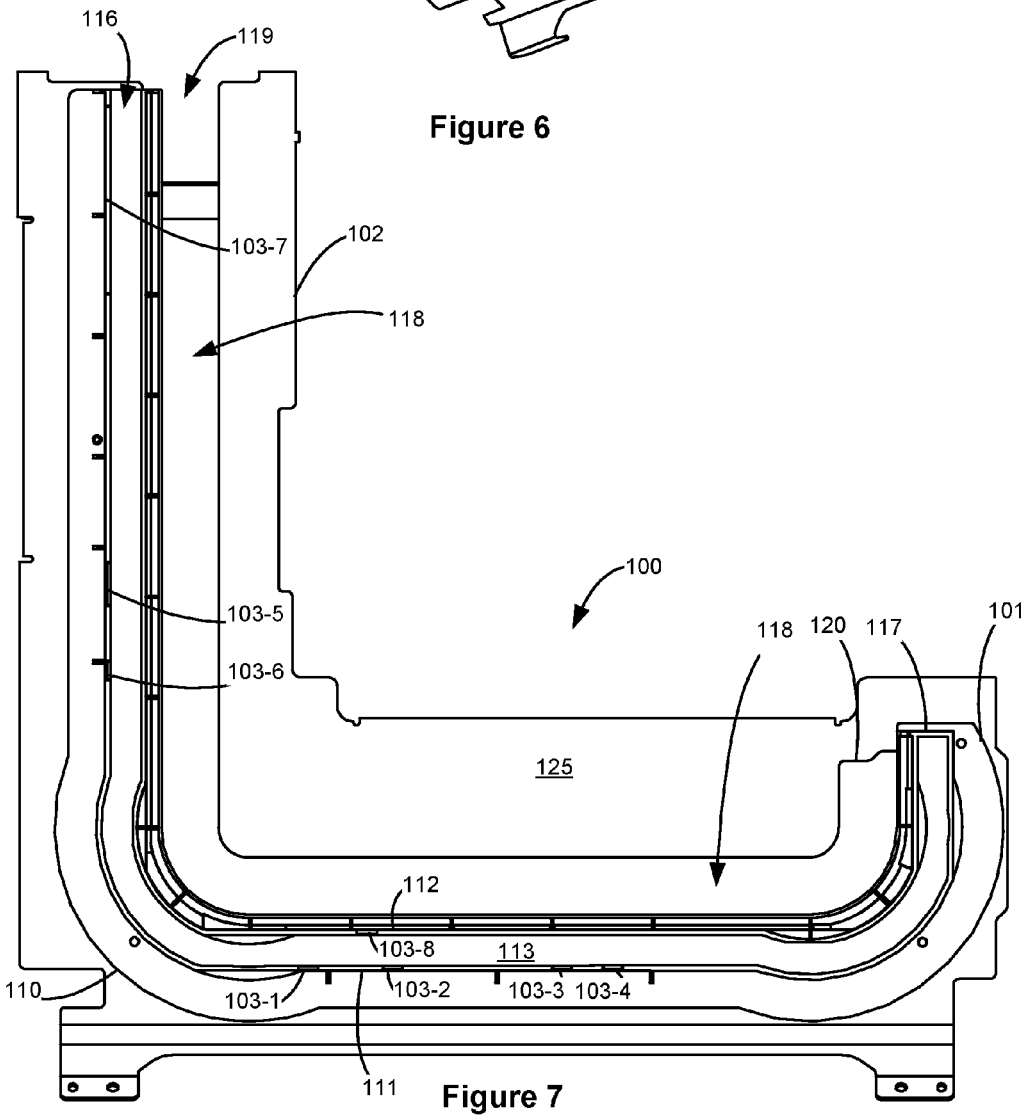
FIG. 7 is a top view of the track assembly of FIG. 6.

Track assembly 100 also includes one or more position flags, generally designation by reference numeral 103, at predetermined locations along a top of one of the outer or inner walls 111, 112. As illustrated position flags 103 are positioned on the top 115 of outer wall 111. Position flags 103 are illustrated as being planar members each having the same approximate height but may be of different lengths. Position flags 103 are sized to pass through flag sensor 250 causing an output signal thereof to change from a first state to a second state and then back to the first state as carriage assembly 200 and flag sensor 250 moved along track 100. Position flags 103-1, 103-2, and 103-3, 103-4, and 103-5, 103-6 are positioned on track 100 at the respective ends of top edge alignment guides 505-1, 505-2, and left edge alignment guide 506, respectively (see FIG. 6). Position flag 103-6 may also serve to locate a "ready position" of stapler 300. Position flags 103-1-103-6 are sensed by flag sensor 250 to allow controller 3 to determine the position of stapler 300 with respect to known obstructions, such as alignment guides 505-1, 505-2, 506, that would prevent stapler 300 from being able to staple media stack 600. Position flag 103-7 is provided on outer wall 111 adjacent open end 116 of channel 113. Position flag 103-7 may serve to locate a home position or access position of stapler 300. Position flag 103-7 may also be used during periodic calibrations of carriage position encoder 251 to adjust for wear and tear on carriage assembly 200 and stapler 300. Position flags 103 may also be provided on the top or free end of inner wall 112. Position flag 103-8 is an example. When used, either flag sensor 250 would be moved on carriage assembly 200 to be aligned with position flags provided on inner wall 112 or a second flag sensor would be provided on carriage assembly 200.

The output signal of flag sensor 250 representative of the position of carriage assembly 200 and stapler 300 on track assembly 100 and an output signal of a position encoder 251 representative of the velocity or speed of carriage assembly 200 are used by controller 3 to move carriage assembly 200 and stapler 300 to and from the home position, to and from the ready position and to each location of media stack 600 to be stapled. Encoder 251 is provided in drive assembly 230 and operably coupled to motor output shaft 232 of motor 232.

Referring now to FIGS. 5-9, in track assembly 100, a continuous J-shaped track 101 is on mounted on a track support 102, which in one form is a metal plate. Although the track 101 is continuous, it may be described as having at least three contiguous track portions along one of the right or left edges RE, LE and along the top edge TE of media stack 600 and which are connected with a curved track portion provided adjacent to the respective corners of the top edge and the left and right edges. As shown there are five contiguous portions—a left edge portion 104, a top edge portion 105, a right edge portion 106, a top left curved portion 107 and a top right curved portion 108. Top left curved track portion 107 is contiguous with left edge and top edge track portion 104, 105 while top right curved track portion 108 is contiguous with top and right edge track portions 105, 106. When media stack 600 is present in media receiving area 501 on media support 500, left and right edge track portions 104, 106 would be adjacent to the left and right edges LE, RE of media stack 600, top edge track portion 105 would be adjacent to the top edge TE of the media stack 600, top left curved track portion 107 would be adjacent to a corner formed between top edge TE and left edge LE of media stack 600 and top right curved portion would be adjacent to a corner former between top edge TE and right edge RE of media stack 600. As viewed media stack 600 is stapled with the top edge TE being lower and abutting top edge alignment guides 505-1, 505-2 that are spaced apart along media support 500 at predetermined locations. As illustrated alignment guides 505-1, 505-2, 506 are C-shaped with an upper portion thereof covering respective portions of the top of media stack 600 (FIG. 3). The illustrated design of alignment guide would obstruct stapling by stapler 300.

Track 101 may be formed as a molded plastic piece having a base plate 110 on which are formed or mounted outer and inner parallel walls 111, 112 forming guide channel 113 therebetween. Base plate 110 mounts to a top surface 125 of track support plate 102. Gussets 114 may be provided along the outer surfaces of outer and inner walls 111, 112 walls and base plate 110 to provide stiffening. Guide channel 113 has an open end 116 and a closed end 117. A slot 118 is provided in support plate 102 parallel to and inboard of guide channel 113. Slot has an open end 119 and a closed end 120 positioned adjacent to open and closed ends 116, 117 of guide channel 113. The open ends 116, 119 allow carriage assembly 200 to be installed on the track 101 and may also be referred to as a carriage assembly access. The closed ends 117, 120 provide a stop. Carriage 201 has an upper chassis 202 that rides on the track 101 and/or top surface 205 and a lower chassis 203 that rides beneath track 101 on a bottom surface 126 of track support 102. Slot 118 accommodates the passage of a support member 204 that interconnects the upper and lower chasses 202, 203.

Figure 8:
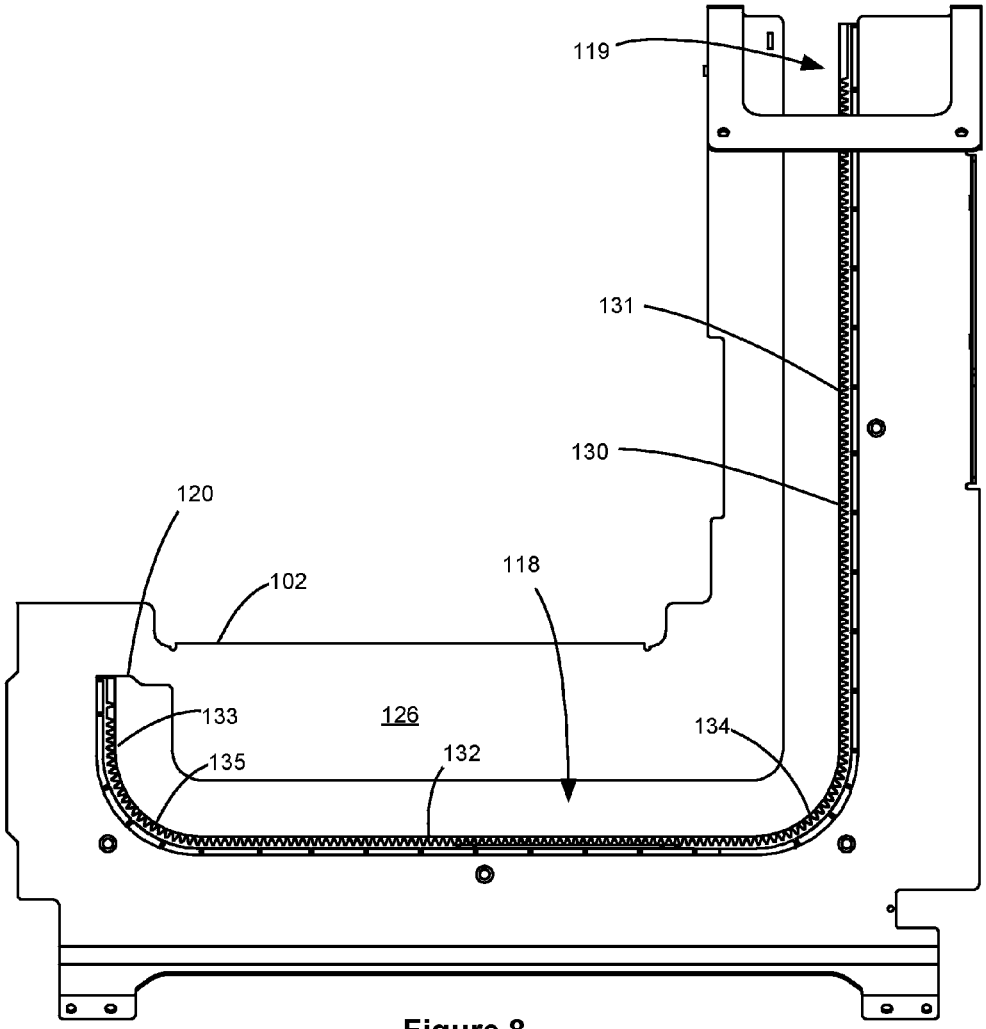
FIG. 8 is a bottom view of the track assembly of FIG. 6.
Figure 9:
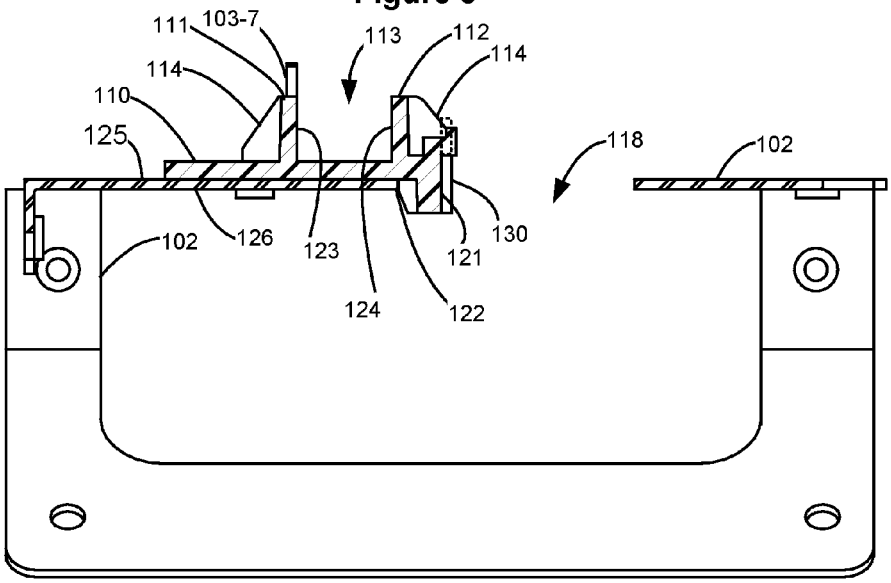
FIG. 9 is a cross-section of the track assembly taken along line 9-9 in FIG. 6.

As can be better seen in FIGS. 8-9, track 101 includes a continuous rack 130 that is formed along slot 118. Rack has a left edge rack portion 131, a top edge rack portion 132, a right edge rack portion 134, a top left curved rack portion 135 and a top right curved rack portion 136 arranged in the same manners as track portions 104-108. As shown rack 130 is J-shaped. A drive assembly 230 on carriage assembly 200 cooperatively engages with rack 130 to move carriage assembly 200 and stapler along track 101 and channel 113. Rack 130 may be formed along inner edge 121 of base plate 110 and may extend above and/or below base plate 110. As shown rack 130 extends along an outer edge 122 of slot 118 and therethrough beyond bottom surface 126 of support 102. The height of rack 130 is a matter of design choice and should not be considered as a limitation. The shape of rack 130 and channel 113 conform to each other and each is continuous along substantially the entire length of track assembly 100 beginning at open ends 116, 119 through to closed ends 117, 120, respectively.

Track 101 including rack 130 may have different configurations as described below, but, in one form, has portions extending parallel to a corresponding a first long edge (left edge LE) and an adjoining short edge (top edge TE) of media stack 600. Unless otherwise stated, rack 130 will conform to the same shape configuration as track 101. This allows the carriage assembly 200 to move along the track 101 to position stapler 300 at desired stapling locations along the long edge and/or short edge, as well as across the adjoining corner of the media stack 600. The stapling locations are either a default stapling position, for example, a position adjacent to the ready position, or one of a number of user-selected stapling patterns, generally designated with reference numeral 700, stored in memory 9 and displayed on user interface 6 for selection. Other configurations of track 101 may be used, as long as at least two contiguous portions extend substantially parallel to corresponding contiguous edges of media stack 600 in the media receiving area 501.

Figure 11:
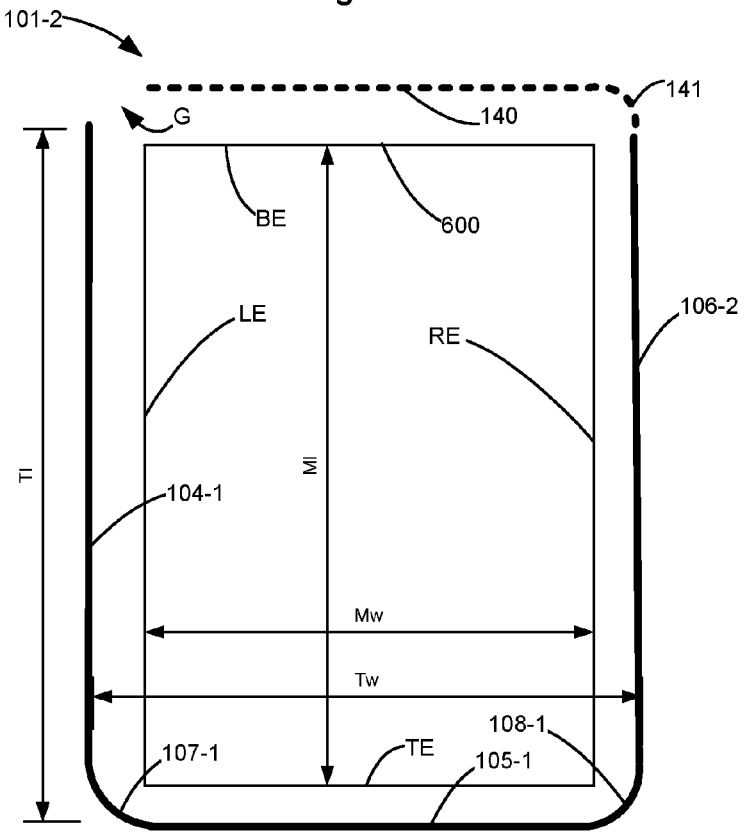
FIG. 11 is a schematic illustration of a U-shaped track assembly.

FIGS. 10-11 illustrate a J-shaped track configuration 100-1 and a U-shaped track configuration 100-2 positioned about media stack 600. The length and width of media stack 600 is indicated by Ml and Mw is shown. The length and width of track is indicated by Tl and Tw. In FIGS. 10-11, track length Tl comprised of left edge portion 104-1 plus top left curved track portion 107-1 and track width Tw comprised of top edge portion 105-1 plus top left and top right curved portions 107-1, 108-1 are greater than the respective media length Ml and width Mw of media stack 600. With the J-shaped track configuration 101-1, the right edge track portion 106-1 and top right curved portion is sized to allow stapler 300 to place either a corner staple or a parallel staple adjacent to the top right corner of media stack 600. With the U-shaped track configuration 101-2, whereas right edge track portion 106-2 and top right curved track portion 108-1 has a length matching left edge track portion 104-1 and top left curved track portion 107-1. FIG. 11 also illustrates a track configuration substantially enclosing the media stack 600 by use of the addition of bottom edge track portion 140 and bottom right curve track portion 141 shown in dashed lines. A gap G may be left between left and bottom edge track portions 104-1, 140 for providing an access location to the track for carriage assembly 200 and stapler 300.

Figure 12A:
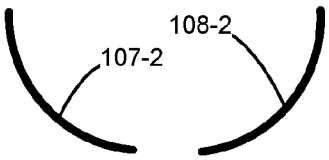
FIGS. 12A-12C illustrate various corner configurations for the track assembly.
Figure 12B:
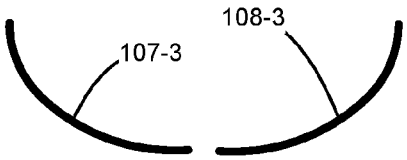
Figure 12C:
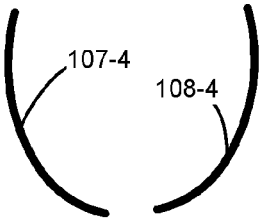
Figure 13:
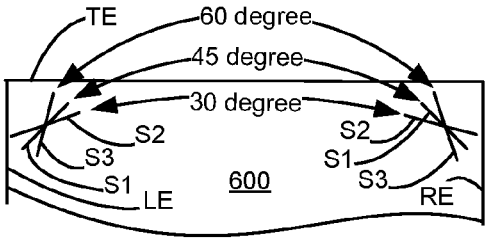
FIG. 13 illustrates variation in placement of corner staples depending on the corner configuration used with the track assembly

FIGS. 12A-12C illustrate various corner configurations with FIG. 12A illustrating a left and right circular curved track portions 107-2, 108-2. FIG. 12B illustrates a left and right curved track portions 107-3, 108-3 having a horizontal elliptical profile. FIG. 12C illustrates left and right curved track portions 107-4, 108-4 having an upright or vertical elliptical profile. Using the configurations of FIG. 12A a corner staple S1 would be placed at about a forty-five degree angle across the respective corner of media stack 600. Using the configurations of FIG. 12B a corner staple S2 would be placed at about a thirty degree angle across the respective corner of media stack 600. Using the configurations of FIG. 12C a corner staple S3 would be placed at about a sixty degree angle across the respective corner of media stack 600. These corner staple positions are illustrated in FIG. 13 for both the right and left upper corners of media stack 600 adjacent top edge TE and left and right edges LE, RE, respectively. While the various curved track portions are shown as being substantially symmetrical, non-symmetrical curved track portions may be used. For example, top right curved track portion 107-2 may be combined with top right curved track portion 108-3. The shape of the curved track portions is a matter of design choice and should not be taken as a limitation.

Figure 14A:
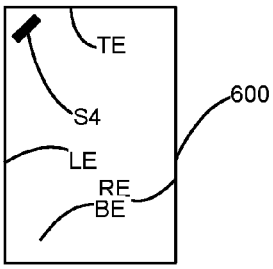
FIGS. 14A-14I illustrate various staple patterns that may be provided by the stapling system.
Figure 14B:
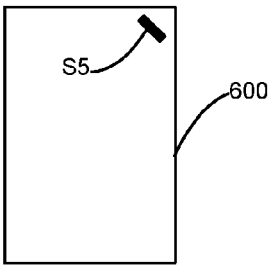
Figure 14C:
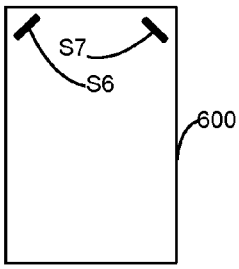
Figure 14D:
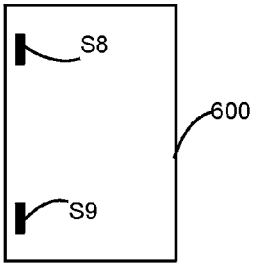
Figure 14E:
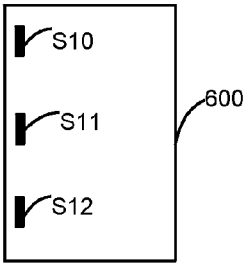
Figure 14F:
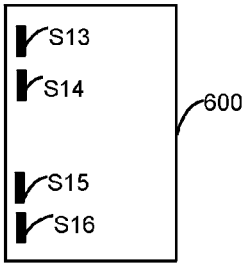
Figure 14G:
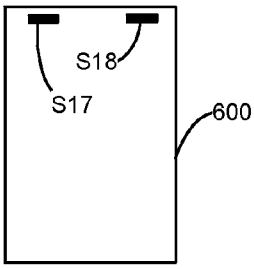
Figure 14H:
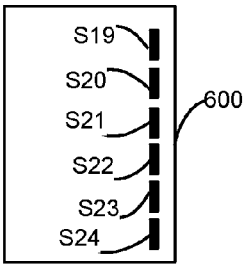
Figure 14I:
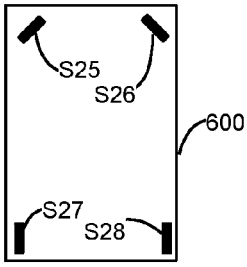

FIGS. 14A-14I illustrate example staple patterns. In FIG. 14A the top, right, left, and bottom edges TE, RE, LE, and BE are indicated. However in the remaining series of FIGS. 14B-14I these reference designations will be omitted for purposes of clarity. In FIG. 14A, staple S4 is a corner staple diagonally positioned adjacent top edge TE and left edge LE and stapler 300 would be positioned as shown in FIG. 5. In FIG. 14B, staple S5 is a corner staple diagonally positioned adjacent top edge TE and right edge RE. Stapler 300 would be positioned in the corner opposite to where it is shown in FIG. 5. In FIG. 14C, staples S6, S7 are corner staples positioned adjacent left edge LE and top edge TE and right edge RE and top edge TE, respectively. In FIG. 14D staples S8, S9 are shown parallel to left edge LE adjacent to the top and bottom edges TE, BE, respectively. In FIG. 14E staples S10, S12 are shown parallel to left edge LE adjacent to the top and bottom edges TE, BE, respectively, with staple S11 approximately centered between staples S10, S12. FIG. 14F illustrates two pairs of stapled S13, S14 and S15, S16 positioned parallel to left edge LE with staples S13, S14 placed adjacent top edge TE and staples S15, S16 placed adjacent bottom edge BE. FIG. 14G shows staples S17, S18 positioned parallel to top edge TE of media stack 600. FIG. 14H shows staples S19-S24 in a line parallel to right edge RE of media stack 600. In FIG. 14I staples S25, S26 are corner staples adjacent top edge TE and left and right edges LE, RE respectively while staples S27, S28 are shown parallel left and right edges LE, RE, respectively, and adjacent to bottom edge BE. The patterns shown in FIGS. 14H-14I may be done using the track configurations shown in FIG. 11. The previous stapling patterns are possible stapling patterns that may be used and are intended only to be non-limiting examples of stapling patterns and not as a limitation.

Figure 15:
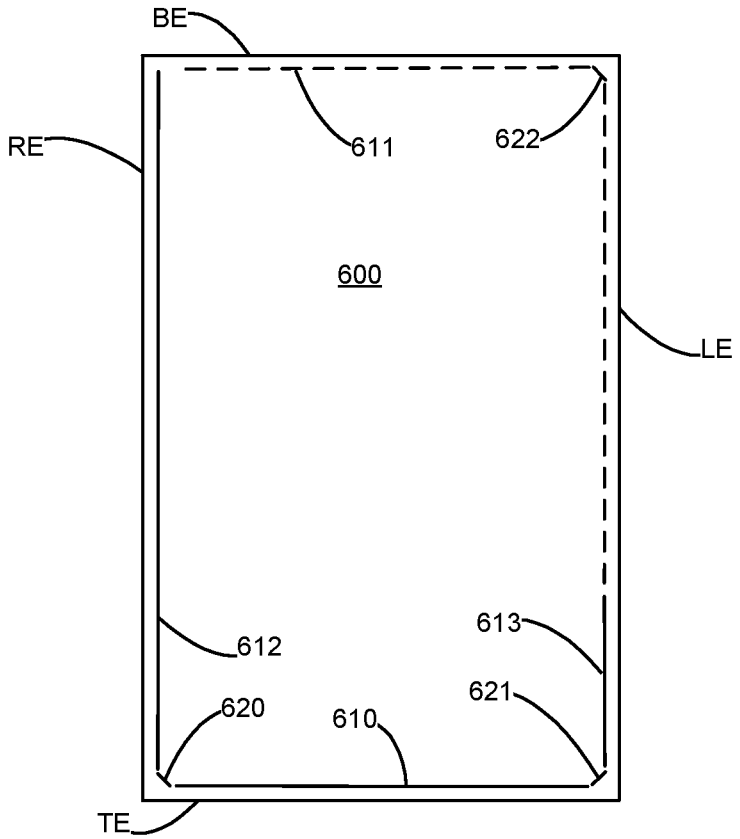
FIG. 15 illustrates a stapling line on the media stack available with either the J-shaped or U-shaped track assembly.

FIG. 15 illustrates stapling lines available with the previously described track configurations. Media stack 600 is again shown in an inverted position having top edge TE, bottom edge BE, left edge LE and right edge RE. Adjacent each respective edge are top edge stapling line 610, bottom edge stapling line 611, left edge stapling line 612 and right edge stapling line 612. Stapling lines 610-613 generally run parallel to and inboard of their respective edge of media stack 600. Top left corner, top right corner and bottom right corner stapling positions are indicated at 620, 621, and 622, respectively. The solid stapling lines and corner positions 620, 621 would be possible with the J-shaped track and rack configuration of FIG. 10. The added dashed line portion of right edge stapling line 613 together with the solid stapling lines would used with the U-shaped track and rack configuration of FIG. 11. Bottom stapling line 611 and bottom right corner stapling position 622 would be available with the alternate embodiment of the track and rack configuration shown in FIG. 11. The amount that each stapling line or corner stapling position is inboard of the respective edge or corner is determined by the type of stapler attached to the carriage assembly 200. In general the stapling lines and corner stapling positions are from about 3 mm to about 17 mm inboard of the respective side or top edge and about 17 mm from a corner.

Figure 17:
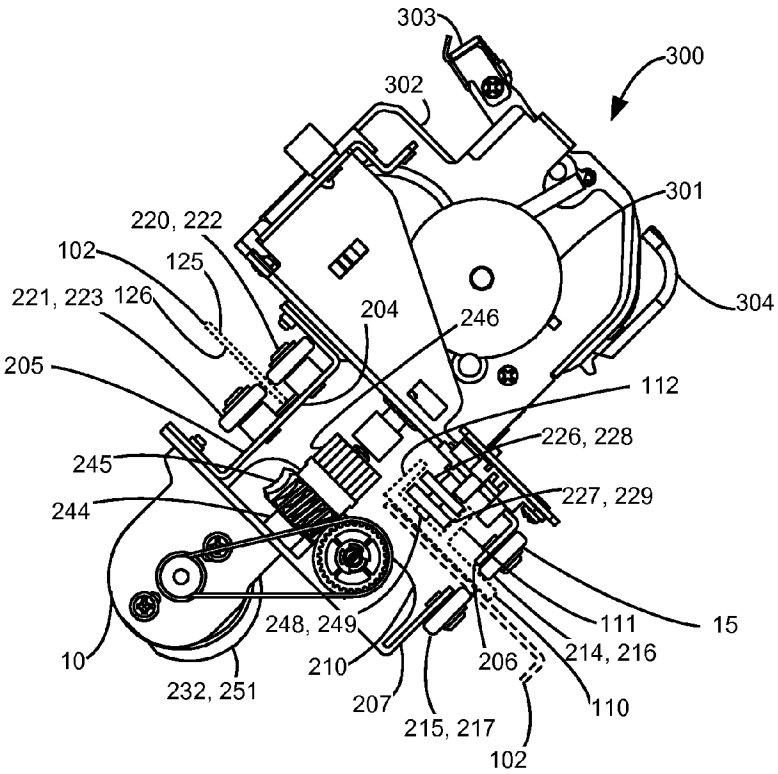
FIG. 17 is an illustration of the stapler and carriage assembly rotated ninety degrees from the position shown in FIG. 15.
Figure 16:
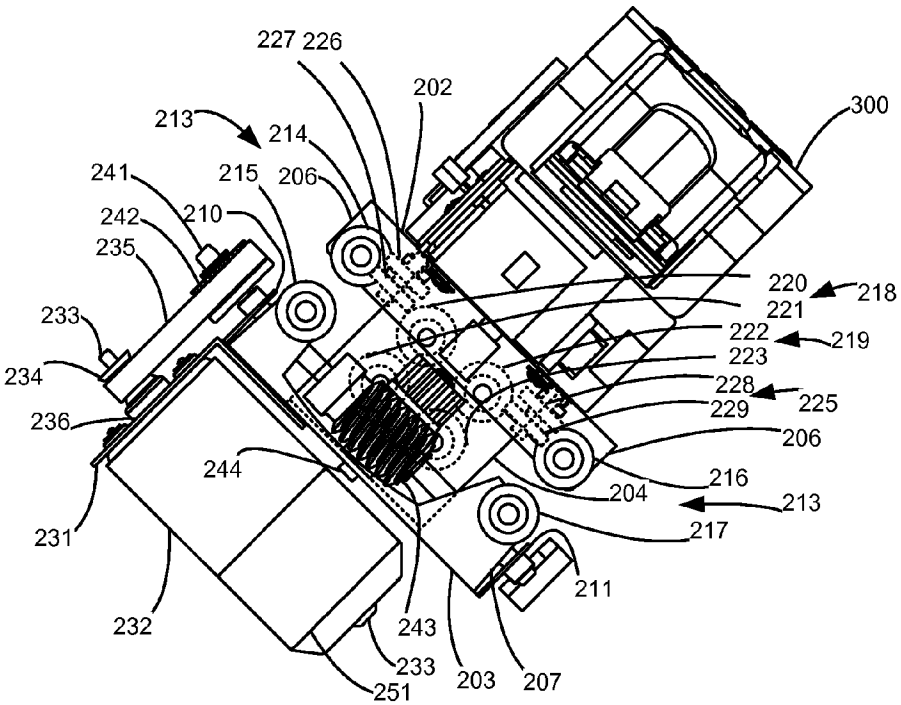
FIG. 16 is an illustration of the stapler and carriage assembly with a support cutaway to show a drive train.
Figure 18:
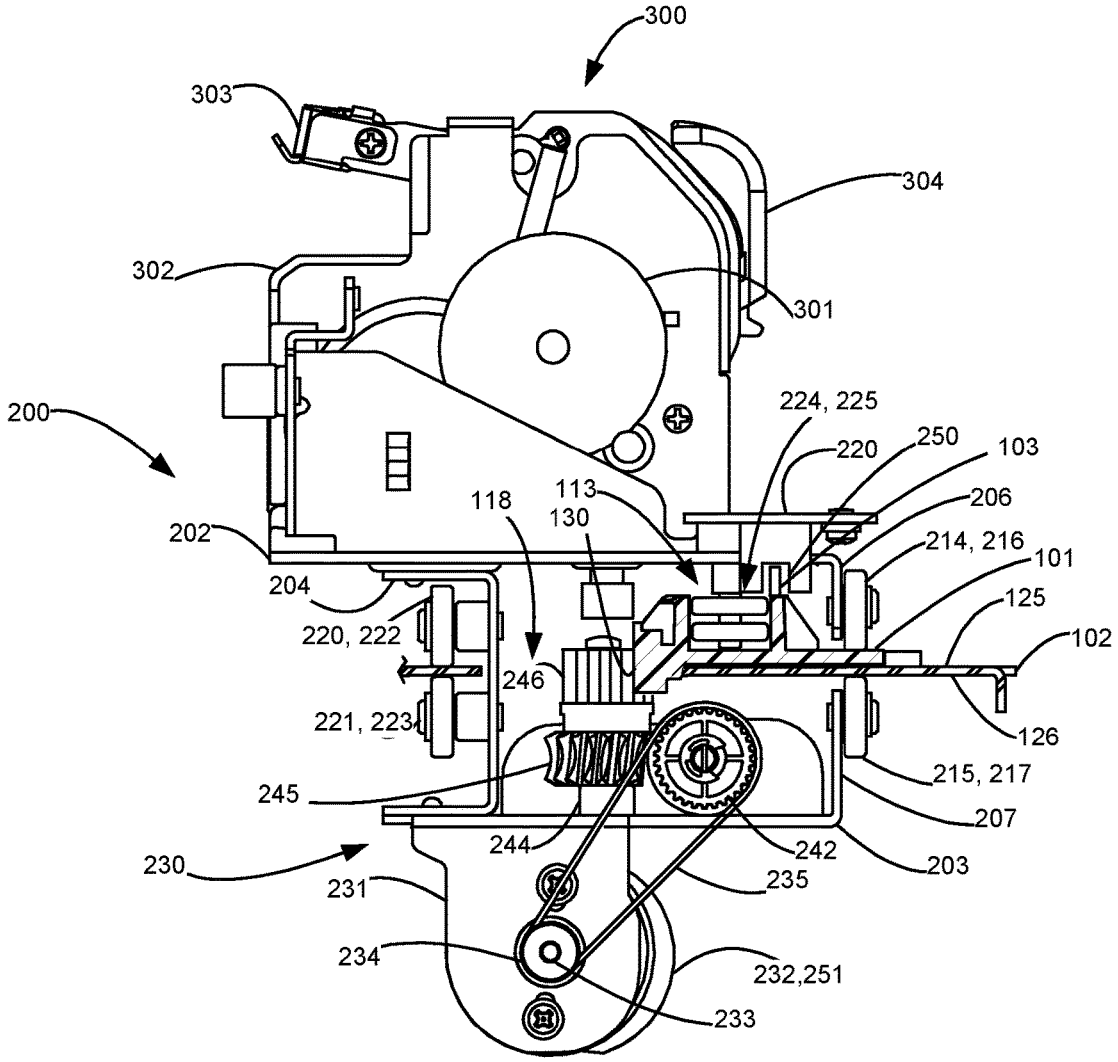
FIG. 18 is partial sectional illustration showing the engagement of the carriage assembly with the track assembly.

Referring now to FIGS. 16-18 an example embodiment of carriage assembly 200 having stapler 300 mounted thereto is illustrated. Carriage assembly 200 comprises a carriage 201 moveable coupled to track 101 and a drive assembly 230. Carriage 201 includes an upper chassis 202 and a lower chassis 203 coupled together by chassis support 204. Upper chassis 202 has a downwardly depending flange 206 that is aligned with an upwardly depending flange 207 on lower chassis 203. Lower chassis 203 also has two opposed upwardly depending supports 210, 211 that are positioned adjacent and transverse to respective ends of flange 207.

Drive assembly 230 is mounted to lower chassis 203 while stapler 300 and flag sensor 250 are mounted to upper chassis 202. Drive assembly 230 is coupled to track 101 and is used to move carriage assembly 200 to the desired stapling locations. Drive assembly 230 includes a motor 232 that may be a closed-loop DC motor, an AC motor, a stepper, or any one of the other types of reversible motor as is known in the art. Motor 232 is fastened to one leg of L-shaped motor support 231 while the other leg is fastened to lower chassis 203. Motor support 231 may also be formed as part of lower chassis 203. As shown the output shaft 233 of motor 232 extends through an opening 236 in motor support 231. Attached to output shaft 233 outboard of motor support 231 is motor gear 234 or motor pulley 234. Opposed shaft supports 210, 211 rotatably support a drive shaft 241 therebetween. Drive shaft 241 is positioned parallel to output shaft 233. Mounted on drive shaft 241 between opposed supports 210, 211 is worm gear 243. Gear 242 or pulley 242 is mounted on an end of drive shaft 241 that is adjacent to output shaft 232. As shown gear 242 is mounted outboard of shaft support 210. Drive belt is coupled to gears 234, 242 to transfer torque from motor 232 to drive shaft 241. Drive assembly 230, as illustrated, is designed to rapidly accelerate carriage assembly 200 and stapler 300 to a velocity of about 100 mm/sec during transit between stapling locations which typically may have a minimum separation of about 50 mm.

Transverse drive shaft or trans-axle 244 is rotatably mounted to lower chassis 203 perpendicular to drive shaft 241. Mounted on trans-axle 244 are transfer gear 245 and pinion gear 246. Transfer gear 245 meshes with worm gear 243 while pinion gear 246 will mesh with rack 130 when installed on track assembly 100 (See FIG. 17). Rotary motion of motor 232 is translated through drive shaft 241, worm gear 243, transfer gear 245, trans-axle 244 to pinion gear 246 allowing carriage assembly to move along rack 130 and track 101. With motor 232 stopped, the friction between worm gear 243 and transfer gear 245 and pinion gear 246 and rack 130 is sufficient to hold carriage assembly 200 and stapler 300 in place on track assembly 100.

Mounted on opposite ends of flanges 206, 207 are first and second carriage outer wheel pairs 212, 213. First carriage outer wheel pair consists of upper wheel 214 rotatably mounted on flange 206 opposite to lower wheel 215 rotatably mounted on flange 207, 216. Second carriage outer wheel pair consists of upper wheel 216 rotatably mounted on flange 206 opposite to lower wheel 217 rotatably mounted on flange 207. Upper wheels 214, 216 and lower wheels 215, 217 are spaced to that upper wheels 214, 216 will ride on an upper surface of base plate 110 of track 100 and lower wheels 215, 217 will ride on bottom surface 126 of support plate 102 when carriage assembly 200 is installed on track assembly 100.

Mounted on an outer surface 205 of chassis support 204 are first and second carriage inner wheel pairs 218, 219. Carriage outer wheel pairs 212, 213 would ride outside of outer wall 111 while carriage inner wheel pairs 218, 219 would ride inside of inner wall 112 (See FIG. 16). First carriage inner wheel pair 218 consists of upper wheel 220 rotatably mounted on chassis support 204 opposite to lower wheel 221 also rotatably mounted chassis support 204. Second carriage inner wheel pair 219 consists of upper wheel 222 rotatably mounted on chassis support 204 opposite to lower wheel 2223 rotatably mounted on chassis support 204. Upper wheels 220, 222 and lower wheels 221, 223 are spaced so that upper wheels 220, 222 will ride on an top surface 125 of support plate 102 and lower wheels 221, 223 will ride on bottom surface 126 of support plate 102 when carriage assembly 200 is installed on track assembly 100.

While four wheels are illustrated being attached to upper and lower chassis 202, 204, in an alternate form only a single wheel may be provided on one of the upper or lower chasses 202, 203 with three tires being provided on lower and upper chasses 203, 202, respectively. Because of the angle at which track assembly 100 is mounted, having wheels carriage 201 in contact with both the top and bottom surfaces of track assembly 100 ensures stability of carriage 201 as it moves, preventing it from twisting and causing misalignment of pinion gear 246 with rack 130 and/or misalignment of stapler 300 with media stack 600.

Wheel pairs 211, 212, 218, 219 have support carriage assembly 200 and stapler 300 on track assembly 100. However to ensure that pinion gear does not slip relative to rack 130, at least one guide wheel mounted on carriage 200 and receive in channel 113 is provided for at least this purpose. As shown a first and a second channel guide wheel pairs 224, 225 are rotatably mounted in a downward depending fashion from upper chassis 202. First channel guide wheel pair 224 consists of upper guide wheel 226 and lower guide wheel 227 both rotatably mounted to axle 248. Second channel guide wheel pair 225 consists of upper guide wheel 228 and lower guide wheel 229 both rotatably mounted to axle 249. Guide wheels 226, 227, 228, 229 are transverse to wheels 204, 206, rotate parallel to base plate 110, and ride in channel 113 along the inner surfaces 123, 124 of outer and inner walls 111, 112 (See FIG. 9).

Flag sensor 250 is positioned on carriage 201, as shown flag sensor 250 is mounted on upper chassis 202, so that carriage flag sensor 250 is actuated by the position flags 103 as the carriage 201 passes by each position flag 103 on track 101. Carriage position encoder 251 is attached output shaft 233 of motor 231 and is rotated thereby to provide a signal used to determine carriage velocity and position along track 101. A door position sensor 61 may be provided and is illustrated as mounted on frame 60 of finisher 7 (see FIG. 3). Door position sensor 61 provides a signal to controller 3 and, when actuated due to a door of the finisher 7 being opened, that signal may used to return carriage assembly 200 to a predetermined home position on track 101. Carriage flag sensor 250 and door position sensor may be an optical interrupter type sensor, a micro switch sensor or other equivalent sensor as is known in the art.

Stapler 300 includes a motor 301, stapler head 302, anvil 303 and staple supply spool 304 for supplying staples to stapler head 302. Motor 301 moves anvil 303 with respect to stapler head 302, as indicated by the dashed lines and doubled headed arrow. During a stapling operation anvil 303 is moved toward stapler head 302 to trap media stack 600 therebetween. Stapler head 302 fires a U-shaped staple 305 through the trapped media stack 600 with the ends of the staple 305 being driven against anvil 303, cinching the media sheets 601 together. One example stapler suitable for use as stapler 300 is a Model EH-0590HP stapler head, manufactured by MAX, CO., LTD., located at 6-6 Nihonbashi Hakozaki-cho, Chuo-ku, Tokyo, Japan. Another example stapler that may be used as stapler 300 is a Model R951 stapler head, manufactured by Isaberg Rapid AB, Box 115 SE-330 27 Hestra, Sweden.

Tamping assembly 400 is positioned adjacent to media support area 501. Bottom edge and front edge alignments guides 505, 506 are provided along the bottom and front sides of media support area 501. Media support 500 and edge alignment guides 505. 506 hold the media sheets 601 in place, while the tamping assembly 400 is used to align the media sheets 601 into a media stack 600 prior to stapling. Top side and rear side tamping arms 402, 403 are connected to first and second tamping motors 404, 405 via first and second translating drive mechanisms 406, 407, respectively. Tamping arm 402, when actuated, moves the media sheets 601 against front edge alignment guide 505 while tamping arm 403, when actuated, moves the media sheets 601 against front edge alignment guide 506.

Door sensor 61, carriage motor 231, flag sensor 250, carriage position encoder 251, stapler motor 301, stapler head 302, and first and second tamping motors 404, 405 are in operable communication with controller 3 via communication link 34.

The media receiving area 501 on media support 500 is sized to hold a number of media sheets 601 depending on the capacity of the stapler 300. Typically stapler 300 has a capacity to staple together about fifty media sheets of standard 20 pound weight, but this will vary based on the media type (thickness) of the media sheets. The signals received from media type sensors 30 by controller 3 may be used to limit the number of media sheets 601 sent to stapling system 11.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A media stapling system, comprising:

a media support for holding a media stack having at least two media sheets for stapling;

a track assembly having a support plate and a track mounted thereon, the support plate and media support having parallel planar orientations, the track having a curved track portion and a first and a second track portions contiguous with respective ends of the curved portion, each track portion having a rack thereon forming a continuous rack length therealong, the first and second track portions being positioned proximate to the media support and parallel to a first edge and a second edge of the media stack that are contiguous with one another with the curved track portion positioned adjacent a first corner of the media stack formed between the first and second edges;

a carriage moveably coupled to the rack and moveable along the first, second and curved track portions;

a position sensor disposed on the carriage for sensing the position of the carriage on the track;

a stapler mounted on the carriage;

a drive mechanism coupled to the rack and the carriage for moving the carriage and stapler along the track; and a controller in operable communication with to the drive mechanism, the position sensor and the stapler, wherein the controller energizes the drive mechanism to move the carriage and stapler along the track to at least one predetermined stapling position along the first and second edges of the media stack and, when, at the at least one predetermined stapling position energizing the stapler to staple the media stack.

2. The media stapling system of claim 1, wherein the track further includes a second curved track portion and a third straight track portion, the second curved portion having one end contiguous with a free end of the second straight track portion and the other end contiguous with an end of the third straight track portion, the third straight track portion extending parallel to a third edge of the media stack that is contiguous with the second edge with the second curved track portion positioned about a second corner formed between the second edge and the third edge.

3. The media stapling system of claim 2, wherein the at least one predetermined stapling position include stapling positions along any of the first, second and third edges and the first and second corners of the media stack.

4. The media stapling system of claim 1, wherein the drive mechanism comprises:

a reversible motor mounted on the carriage, the motor having an output shaft having a first gear mounted thereon, the motor being in operable communication with the controller;

a drive shaft rotatably mounted to the carriage, the drive shaft having a worm gear and a second gear mounted thereon with the second gear being aligned with the first gear gear;

a trans-axle rotatably mounted to the carriage, the trans-axle having a transfer gear operably coupled to the worm gear and a pinion gear operably coupled to the rack; and, a drive belt operably coupled to the first and second gears.

5. The media stapling system of claim 4 further comprising;

a first pair of carriage wheels and a second pair of carriage wheels rotatably mounted on opposite sides of the carriage and positioned parallel to the track; and at least one third carriage wheel rotatably mounted to the carriage and aligned with the first and second pairs of carriage wheels, the first and second pairs of carriage wheels riding along a top surface of the support and the at least one third carriage wheel riding on a bottom surface of the support.

6. The media stapling system of claim 4 wherein:

the carriage further comprises at least one guide wheel rotatably mounted to the carriage; and the track has a guide wheel channel formed therein, the guide wheel channel having a continuous length substantially the same as the rack length, the guide wheel channel in spaced alignment with the rack and sized to closely receive therein the at least one guide wheel.

7. The media stapling system of claim 5 wherein:

the at least one guide wheel comprises two pairs of guide wheels rotatably mounted in a spaced aligned relation ship on the carriage.

8. The media stapling system of claim 6 wherein:

the guide wheel channel is formed by two spaced parallel walls extending from the track;

one or more position flags provided at predetermined positions along a free end of one of the two walls; and the carriage further comprises a flag sensor mounted thereon for sensing the presence of the one or more position flags as the carriage moves along the track, the flag sensor being in operable communication with the controller, wherein, upon sensing each of the one or more position flags, the controller performs one of actuating the stapler to staple the media stack and de-actuating the stapler to preclude stapling at the predetermined position of the one or more position flags.

9. The media stapling system of claim 4 wherein the position sensor is an encoder operably coupled to output shaft of the motor.

10. The media stapling system of claim 1, further comprising:

a tamping system positioned about the media support the tamping system being in operable communication with the controller for aligning the first and second edges of the media stack prior to stapling.

11. The media stapling system of claim 1, wherein the support and media support are mounted on a second frame and each is positioned at a substantially same acute angle with respect to horizontal.

12. The media stapling system of claim 1, wherein the at least one predetermined stapling position includes an angled position at one of the first corner, the second corner, and both the first and second corners of the media stack.

13. A media stapling system for use with an image forming device having a user interface and a controller, the user interface providing a menu of one or more predetermined user selectable stapling patterns and a default stapling pattern; each stapling pattern having at least one predetermined stapling position, the media stapling system comprising:

a media feeding system having an input for receiving printed media from the image forming device and providing a media path to a media stapling device and a media output location;

a media stapling device, comprising:

a planar media support for holding the printed media received from the media feeding system in a media stack for stapling;

a track assembly having a planar support plate and a track mounted thereon, the support plate and media support having parallel planar orientations, the track having a curved track portion and a first and a second track portions contiguous with respective ends of the curved portion, each track portion having a rack thereon forming a continuous rack length therealong, the first and second track portions being positioned proximate to the media support and parallel to a first edge and a second edge of the media stack that are contiguous with one another with the curved track portion positioned adjacent a first corner of the media stack formed between the first and second edges;

a carriage moveably coupled to the rack of the track;

a position sensor disposed on the carriage for sensing the position of the carriage along the track and providing position data of the carriage;

a stapler mounted on the carriage; and a drive mechanism coupled to the track and the carriage for moving the carriage along the track;

and, the controller being in operable communication with the user interface, the media feeding system, the drive mechanism, the position sensor and the stapler, wherein the controller is configured to:

actuate the media feeding system to feed the received printed media to the media support, actuate, based on one of the default stapling pattern and a selected stapling pattern, the drive mechanism to move the carriage and stapler along the track from an initial position track to the at least one predetermined stapling position of one of the default stapling pattern and the selected stapling pattern using position data, actuate, upon the carriage and stapler arriving at the at least one or more predetermined stapling positions, the stapler to staple the media stack, and actuate the media feeding system to move the stapled media stack to the media output location.

14. The media stapling system of claim 13, wherein the planar support plate frame and planar media support are positioned at substantially the same acute angle with respect to a horizontal.

15. The media stapling system of claim 13, wherein:

the support plate has a slot therethrough conforming to the shape of the rack with the rack position along an edge of the slot;

the carriage comprises an upper wheeled chassis and a lower wheeled chassis interconnected by a chassis support, the upper wheeled chassis riding on a top surface of the track and the support plate, the upper wheeled chassis having at least one guide wheel rotatably mounted thereon transverse to the track, the carriage the lower chassis riding on a bottom surface of the support plate with the chassis support being received through the slot in the support plate and the stapler mounted on the upper wheeled chassis;

the drive mechanism is coupled to the lower wheeled chassis, the drive mechanism comprising:

a reversible motor mounted on the lower wheel chassis, the motor having an output shaft having a first gear mounted thereon, the motor being in operable communication with the controller;

a drive shaft rotatably mounted to the lower wheeled chassis, the drive shaft having a worm gear and a second gear mounted thereon with the second gear being aligned with the first gear;

a trans-axle rotatably mounted to the lower wheeled chassis, the trans-axle having a transfer gear operably coupled to the worm gear and a pinion gear operably coupled to the rack; and, a drive belt operably coupled to the first and second gears.

and, the track has an outer wall and an inner formed a guide wheel channel therebetween, the outer and inner walls and the guide wheel channel having a continuous length substantially the same as the rack length, the guide wheel channel in spaced alignment with the rack and sized to closely receive therein the at least one guide wheel.

16. The media stapling system of claim 15 wherein:

one or more position flags are provided at predetermined positions along a free end of the outer wall; and the carriage further includes a flag sensor mounted thereon for sensing the presence of the one or more position flags as the carriage moves along the track, the flag sensor being in operable communication with the controller, wherein, upon sensing each of the one or more position flags, the controller performs one of actuating the stapler to staple the media stack and de-actuating the stapler to preclude stapling at the predetermined position of the one or more position flags.

17. The media stapling system of claim 15, wherein the track further includes a second curved track portion and a third straight track portion, the second curved portion having one end contiguous with a free end of the second straight track portion and the other end contiguous with an end of the third straight track portion, the third straight track portion extending parallel to a third edge of the media stack that is contiguous with the second edge with the second curved track portion positioned about a second corner formed between the second edge and the third edge.

18. The media stapling system of claim 17, wherein the one or more predetermined stapling positions include one of a position that is diagonally across the first corner of the media stack and a position that is diagonally across the second corner of the media stack.

19. The media stapling system of claim 15, further comprising a tamping system for aligning the received media adjacent the media support having two tamping members, one tamping member positioned along each of two contiguous edges of the media support, for aligning the edges of the media stack for stapling.

20. A media stapling system, comprising:

a planar media support for holding a media stack having at least two media sheets for stapling, the media support having an orientation that is at an acute angle with respect to horizontal;

a media feeding system for receiving at least two media sheets from an image forming device and feeding the received at least two media sheet onto the media support;

a track assembly having:

a planar support plate positioned substantially parallel with the media support;

a track mounted on a top surface of the support, the track having at least two contiguous track portions, the at least two contiguous track portions each having a rack extending therefrom forming a continuous rack length, the rack being adjacent an edge of a correspondingly shaped slot in the support plate, the track positioned proximate to the media support with the at least two contiguous track portions being parallel to at least two contiguous edges of the media stack when present, the track further having a wheel guide channel formed in a top surface thereof, the wheel guide channel having at least two contiguous channel portions forming a continuous channel having a shape corresponding to the shape of the rack;

a wheeled carriage moveable along the top surface of the support, the carriage having a guide wheel mounted thereon, the guide wheel positioned transverse to the track and closely received in the wheel guide channel;

an encoder mounted on the wheeled carriage for providing a position data of the wheeled carriage along the track;

a stapler mounted on the wheeled carriage;

a drive mechanism for the wheeled carriage and stapler, drive mechanism having:

a frame having an arm extending through the opening in the support and attached to an underside of the carriage;

a motor mounted on the frame, the motor having an output shaft having a first gear mounted thereon;

a drive shaft rotatably mounted to the frame, the driver shaft having a worm gear and a second gear thereon, the second gear aligned with the first gear;

a trans-axle rotatably mounted to the frame and transverse to the drive shaft, the trans-axle having a transfer gear operably coupled to the worm gear and a pinion gear operably coupled to the rack;

a drive belt operably coupled to the first and second gears;

and and, a controller in operable communication with the motor, the encoder, the stapler and the media feeding system, the controller configured to:

actuate the media feeding system to feed the at least two media sheets to be stapled onto the media support, actuate the drive mechanism to move the carriage and stapler the along the track to one or more predetermined stapling positions located along any of the at least two contiguous edges of the media stack, and, when at the one or more predetermined stapling positions, actuating the stapler to staple the media stack.

21. The media stapling system of claim 20, wherein the at least two contiguous portions of the track include a first, a second and a third portion, the first, the second and the third portions extending parallel to a corresponding edge of three contiguous edges of the media stack.

* * * * *